US007661527B2

(12) United States Patent
Cerf

(10) Patent No.: US 7,661,527 B2
(45) Date of Patent: Feb. 16, 2010

(54) TRAY FOR STACKING CONTAINERS

(76) Inventor: Alain Cerf, 3301 Gateway Center Blvd., Pinellas Park, FL (US) 33782

( * ) Notice: Subject to any disclaimer, the term of this patent is extended or adjusted under 35 U.S.C. 154(b) by 515 days.

(21) Appl. No.: 11/588,211

(22) Filed: Oct. 27, 2006

(65) Prior Publication Data

US 2008/0099362 A1 May 1, 2008

(51) Int. Cl.
*B65D 75/00* (2006.01)

(52) U.S. Cl. ..... 206/432; 53/441; 206/821

(58) Field of Classification Search ..... 206/203, 206/427, 432, 497, 499, 504, 509, 512, 821; 53/398, 441, 449; 220/4.27, 23.83
See application file for complete search history.

(56) References Cited

U.S. PATENT DOCUMENTS 3,351,264 A * 11/1967 Bostrom ..... 206/821
3,385,429 A * 5/1968 Becker et al. ..... 206/432
4,838,419 A * 6/1989 Weits et al. ..... 206/821
4,919,265 A * 4/1990 Lems et al. ..... 206/432
5,016,761 A * 5/1991 Stoddard et al. ..... 206/821
5,636,753 A * 6/1997 Wilkinson et al. ..... 206/821

FOREIGN PATENT DOCUMENTS

GB 2240326 * 7/1991

* cited by examiner

*Primary Examiner*—Luan K Bui
(74) *Attorney, Agent, or Firm*—Sam Silverberg

(57) ABSTRACT

Film wrapped stacked containers having a molded transparent plastic tray 1 inserted between containers 6 and containers 5 are structurally stable to facilitate film wrapping. The top side of the tray has protuberances 2 forming groove rings 4 on the top side of the tray. The groove rings 4 acts to locate the bottom of the containers 5 on top of the tray in a preset configuration. The bottom of containers 5 rest within the groove rings. The bottom side of the tray has separation means such as cones 6 or other protuberances that act to separate and position the containers 6 beneath the tray 1. By providing a plastic insert that can be molded to a preset configuration, structural stability can be provided for containers with different shapes.

15 Claims, 2 Drawing Sheets

TRAY FOR STACKING CONTAINERS

This invention relates to a packaging insert for stacking containers prior to film wrapping. The packaging insert provides a stable platform for stacking containers on top of each other.

BACKGROUND OF THE INVENTION

Packaging inserts made of flat card board are commonly used to stack containers on top of each other. For example a flat card board insert is placed on a six-pack of containers. While the cardboard is resting on top of the six-pack of containers a six-pack is stacked on top of the card board insert. Usually another flat cardboard insert is placed on top of the staked containers. Some times the flat card board inserts are glued to the containers to provide greater stability. These flat cardboard inserts do not provide an adequate structural stability for the stacked containers to facilitate film wrapping. Without the requisite structural stability the stacked containers can be come unstable during film wrapping. This instability can require stopping the film wrapping process to remove any stacked containers that cannot be film wrapped.

SUMMARY OF THE INVENTION

In a film wrapping operation there is a need for a packaging insert that will provide a structure that will support the top containers as well as to insure that the containers maintain their proper position to facilitate stacking. Also there is a need for a packaging insert that can be easily molded to accommodate different shapes of containers. These needs have been solved by using plastic inserts that have been reinforced to provide structural stability and spacers to insure the position of the containers. These plastic inserts provide the structural stability to facilitate stacking and film wrapping.

These plastic inserts provide many benefits other than structural stability in comparison to cardboard inserts. The plastic is not sensitive to moisture as is cardboard. The plastic can be made transparent thereby allowing the logos on the containers to be visible. There is less danger of mold forming on plastic than cardboard

DETAILED DESCRIPTION OF THE INVENTION

Figure 1:
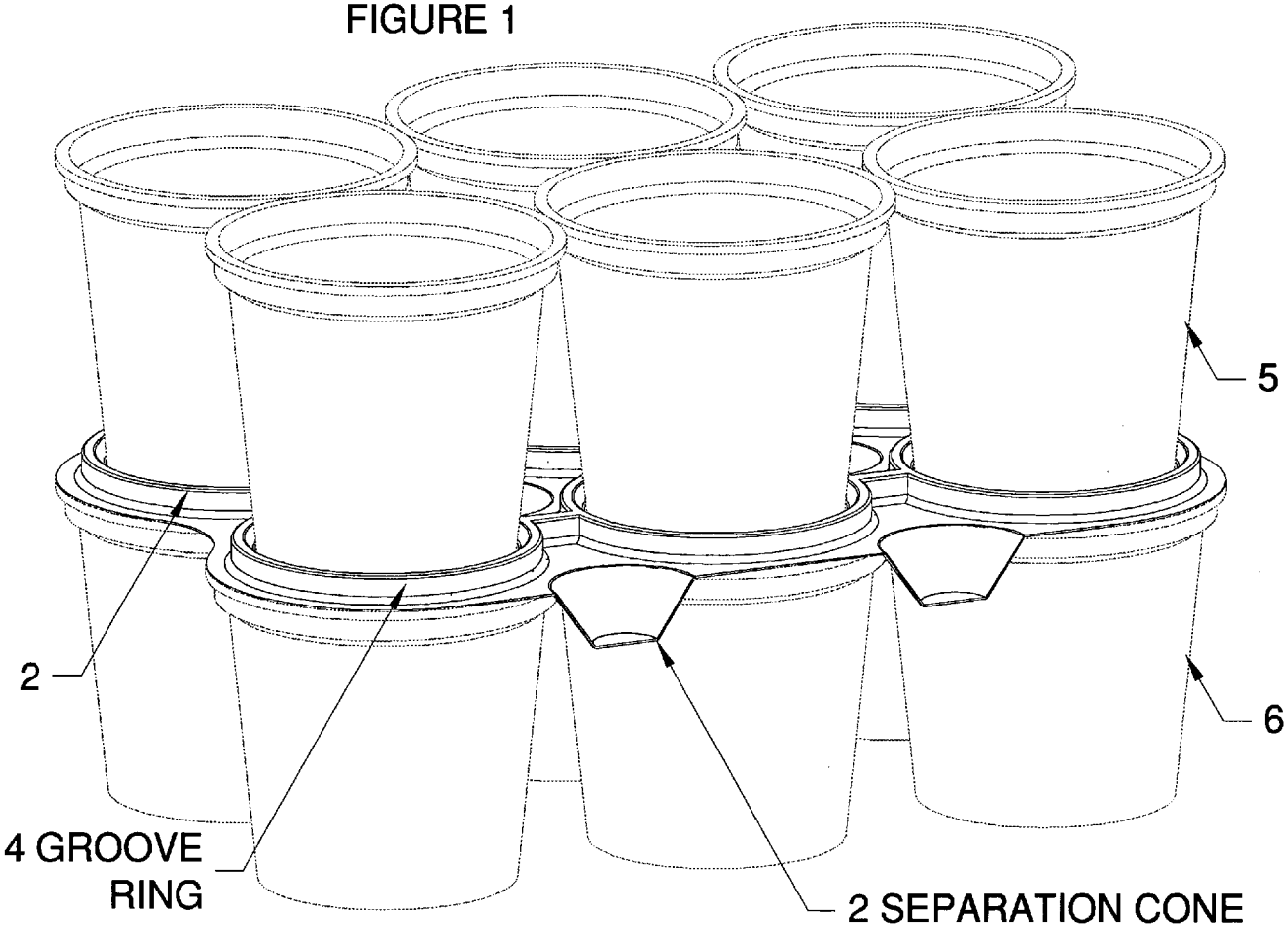
FIG. 1 shows a plastic insert having between stacked cups.
Figure 2:
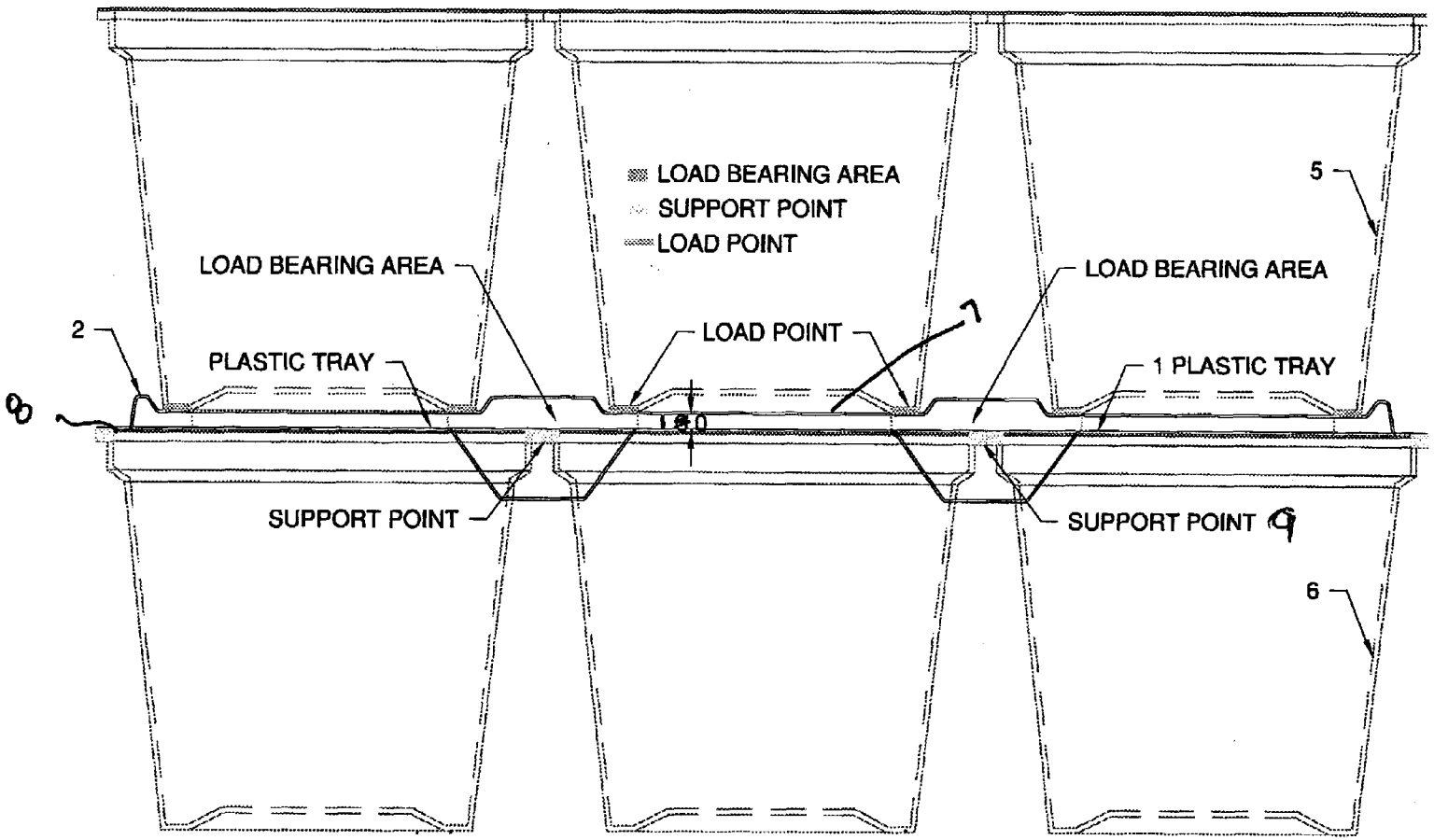
FIG. 2 shows a plastic insert with grooved rings.

FIGS. 1 and 2 show a molded transparent plastic tray 1 with yogurt containers with containers 6 beneath the tray and top containers 5 resting on the tray. The thickness of the tray before deformation is about 0.25 mm. The top side of the tray has protuberances 2 forming groove rings 4 on the top side of the tray. The groove rings 4 acts to locate the bottom of the containers 5 on top of the tray in a preset configuration. The bottom of containers 5 rest within the groove rings. The bottom side of the tray has separation means such as cones 3 or other protuberances that act to separate and position the containers 6 beneath the tray 1. The groove rings and other deformations of the plastic act to reinforce the stability of the insert. By providing a plastic insert that can be molded to preset configurations, structural stability can be provided for containers with different shapes.

In a preferred embodiment the base plastic 8 of the tray is deformed so that plastic bottom of the plastic within the grooved rings is raised about 1 mm above the base plastic 8. This raising provides a spacing that acts a cushion so that the containers 5 do not damage the tops of containers 6 during stacking. For different containers the spacing might be different.

The area of the spacing usually would be less than the top area of the bottom containers 6. Therefore the top edges of the container will contact the support points 9 of the base plastic outside of the raised plastic bottom area of the base plastic. This creates the spacing between the raised plastic bottom and a top of the container.

As shown in FIGS. 1 and 2 a single molded tray between the top containers 5 and bottom containers 6 is sufficient to provide structurally stability for film wrapping. Additional plastic inserts can be used below containers 6 or above containers 5. When additional inserts are used when there are no containers on one side of the insert, this side can be molded without having any protuberances. The protuberances are not needed because this side of the insert does not contact any containers, The thickness of the plastic tray can be any thickness. The thickness can vary as long as the tray provides the structurally stability to support the containers for film wrapping. The protuberances maintain the position of the containers to a degree that structural stability is provided for film wrapping the stacked containers.

The invention claimed is:

1. A process for film wrapping stacked, conically shaped, containers with a molded tray insert that facilitates stacking top containers on the bottom containers comprising providing two or more containers, placing a molded tray insert on top of said containers wherein the insert has raised areas on the top side of the insert that each raised area defines a spacing area that is less than the area defined by a top of a bottom container so that a spacing is created between the top of the bottom container and a bottom of a top container and wherein the bottom side of the insert has separation means for maintaining the tops of the containers in a preset configuration stacking containers on top of said tray insert, and film wrapping the stacked containers with heat shrinkable film.

2. A process according to claim 1 where in the insert is a transparent plastic.

3. A process according to claim 1 including heat shrinking the film after the containers are wrapped.

4. A process according to claim 1 wherein the top of the bottom container contacts support points on the bottom side of the insert outside of the spacing areas on the top side of the insert.

5. A process according to claim 1 wherein the separation means are separation cones.

6. A process according to claim 4 wherein the raised areas on the top side of the insert include protuberances shaped to accommodate the bottom of the top containers and to maintain the position of the containers.

7. A process according to claim 6 wherein the protuberances form groove rings.

8. A process according to claim 1 placing a second molded tray on top of stacked containers or below the bottom of the containers where the second molded tray has means to maintain the position of the containers.

9. A product made by the process of claim 1.

10. A heat shrinkable film wrapped stacked, of conically shaped, containers having a molded plastic insert between top containers and bottom containers wherein the insert has raised areas on the top side that each raised area defines a spacing area that is less than the top area of a bottom container so that a spacing is created between a top of a bottom container and a bottom of a top container and wherein the bottom side of the insert has separation means for maintaining the tops of the containers in a preset configuration.

11. A film wrapped stacked containers according to claim 10 wherein the top of the bottom container contacts support points on the bottom side of the insert outside of the spacing area on the top side of the insert.

12. A film wrapped stacked containers according to claim 10 wherein the raised areas on the top side of the insert includes protuberances shaped to accommodate the bottom of the top containers and to maintain the position of the containers.

13. A film wrapped stacked containers according to claim 12 wherein the protuberances form groove rings.

14. A film wrapped stacked containers according to claim 11 wherein the separation means are separation cones.

15. A film wrapped stacked containers according to claim 10 wherein the film is transparent.

* * * * *